United States Patent [19]

Thiot et al.

[11] 4,094,414

[45] June 13, 1978

[54] CLOTHES HANGING RACK

[76] Inventors: Richard E. Thiot; Phyllis J. Thiot, both of 4981 Cedar Bay St., Orlando, Fla. 32806

[21] Appl. No.: 803,544

[22] Filed: Jun. 6, 1977

[51] Int. Cl.[2] ..... A47F 7/24

[52] U.S. Cl. ..... 211/1.3; 211/101; 211/171

[58] Field of Search ..... 211/1.3, 98, 100, 101, 211/102, 103, 104, 105.1, 110, 111, 170, 171, 172, 173, 174

[56] References Cited

U.S. PATENT DOCUMENTS

| | | | |
|---|---|---|---|
| 1,000,933 | 8/1911 | North | 211/103 X |
| 1,072,089 | 9/1913 | Connelly | 211/172 UX |
| 2,576,067 | 11/1951 | Chandler | 211/104 UX |
| 3,926,315 | 12/1975 | Bernard | 211/102 |

FOREIGN PATENT DOCUMENTS

| | | | |
|---|---|---|---|
| 662,984 | 7/1938 | Germany | 211/101 |

*Primary Examiner*—Roy D. Frazier
*Assistant Examiner*—Robert W. Gibson, Jr.
*Attorney, Agent, or Firm*—Duckworth, Hobby, Allen & Pettis

[57] ABSTRACT

A rack for hanging clothes includes a double tubed slotted storage container which can be attached to the side of a clothes dryer or washing machine or to a laundry room wall. The container contains a telescoping support rod and a clothes hanging bar attached to the telescoping support rod. The rod may be telescoped from the container and locked in position and a clothes hanging bar pivoted to a horizontal position to hang clothes as they are taken from the clothes dryer and placed on the hangers.

9 Claims, 4 Drawing Figures

31
30
27
28
33
32
34
25
17

26
10
16
15
22
12
11
14
23
18
24
20
13
21

CLOTHES HANGING RACK

BACKGROUND OF THE INVENTION

The present invention relates to a clothes hanging rack which is stored in a compact container which may be attached to a clothes dryer or to the washing machine or to a nearby wall so that the clothes rack is neatly stored out of the way until needed for hanging clothes.

In the past, a wide variety of clothes racks and storage racks have been provided for use in hanging clothes for drying as the clothes are taken from a clothes dryer and placed on hangers. Some of the prior art clothes hanging racks conveniently provide ways to fold the rack for more compact storage when the rack is not being used. These racks typically have a center support rod and folding arms so that the horizontal arms may be positioned out of the way when the rack is not being used. The typical prior art rack may be seen in the Roberts patent, U.S. Pat. No. 3,607,498, for a Device for Hanging Washed Clothes, which includes embodiments having a supporting post with clothes rack supporting bars thereon which are adapted to be pivoted between positions. The Henderson patent, U.S. Pat. No. 1,270,156, teaches a clothes rack which may be folded by releasing the rack bracing arms supporting the rack in its horizontal position against a center post. U.S. Pat. No. 2,424,711, to Sanders, illustrates a drying rack having hanging arms which can be swung to a horizontal position from a stored rack position and means for locking the racks in a horizontal position so that a plurality of racks are stored therein.

The Saiki patent, U.S. Pat. No. 3,817,394, teaches an Article Supporting Device which may be used for a coat rack, or the like, which has a central support and removable horizontal supports and may be adjusted for different heights and which may support not only coats but magazines and other articles. The Kirch patent, U.S. Pat. No. 3,174,628, teaches a Wall Bracket having a passageway therethrough which may be attached to the wall and which supports a horizontal bracket for hanging clothes which may be quickly removed from the wall bracket and inserted in the hollow container from the opposite end for storage.

The present invention, on the other hand, teaches a clothes hanging rack attachable to the side of the clothes dryer or to the washer or to a nearby wall for convenient storage in a folding position, and adopted to be quickly raised for hanging clothes removed from the dryer.

SUMMARY OF THE INVENTION

The present invention is a clothes hanging rack which includes a container having at least one bore therein along with a telescopic support rod mounted for telescoping into and out of the bores in the container. The clothes hanging bar is pivotally mounted to the telescoping rod for pivoting from the folded storage position to a horizontal clothes hanger supporting position. The clothes hanging bar telescopes into the container along with the telescoping rod in its storage position. The telescoping rod has a vertical slot therein for rod locking pins to slide in and includes locking slots for sliding said locking pins to position said telescoping rod in an extended raised position. The clothes hanging bar will pivot around until positioned on a support bracket on said telescoping rod.

BRIEF DESCRIPTION OF THE DRAWINGS

Other objects, features and advantages of the present invention will be apparent from the written description and the drawings in which.

DESCRIPTION OF THE PREFERRED EMBODIMENT

Figures 1, 2, 3, 4:
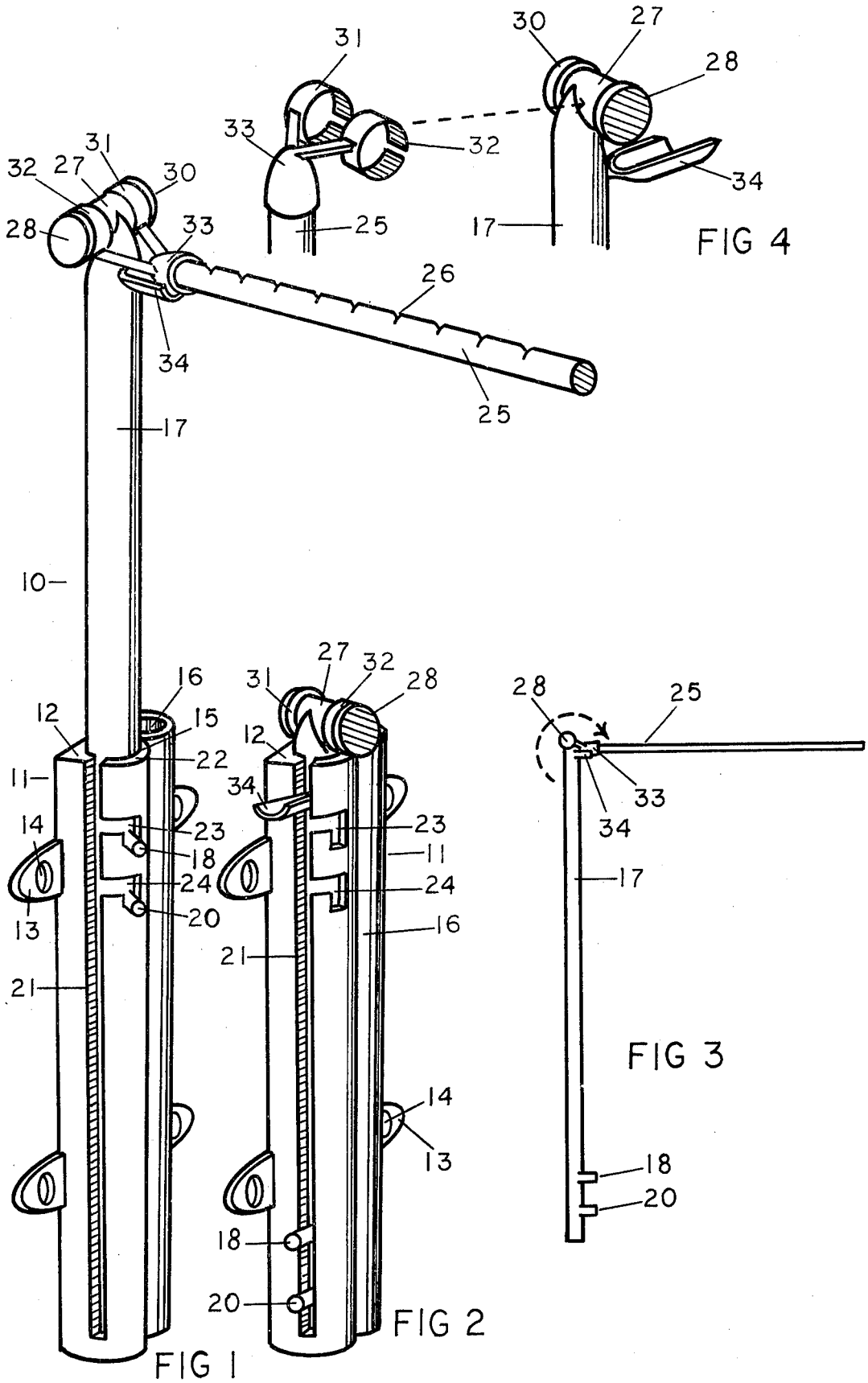
FIG. 1 is a perspective view of a clothes hanging rod in accordance with the present invention in extended working position.
FIG. 2 is a perspective view of a clothes hanging rack in accordance with FIG. 1 in a closed position.
FIG. 3 is a side elevation of a telescoping rod and clothes hanging bar removed from the casing.
FIG. 4 is an exploded view of the pivotal connecting members for connecting and supporting the clothes hanging bar to the telescoping rod.

Referring to the drawings and especially to FIGS. 1 and 2, a clothes hanging rack 10 is supported in a container or casing 11 having a base 12 and a plurality of mounting brackets 13 each having an opening 14 therein for mounting the container 11 to the wall of a washing machine, clothes dryer, or laundry room wall with screws. The container 11 has a pair of bores 15 and 16 extending thereinto with bore 15 having a telescopic center rod 17 slidably mounted therein. The rod 17 has a pair of locking members 18 and 20 fixedly mounted thereto which slide in an elongated slot 21 extending from the top edge 22 of the bore 15 all the way to the bottom portion of the container. The container for bore 15 includes a pair of L-shaped slots 23 and 24 for receiving the locking members 18 and 20 for supporting the rod 17 in a raised position and in a secure manner, but to allow the telescoping rod 17 to be raised slightly and twisted and lowered to its stored position. The telescoping rod 17 has clothes hanging bar 25 pivotally attached thereto which hanging bar 25 has a plurality of notches 26 for positioning coat hangers in a spaced relationship for hanging clothes placed on hangers when removed from the clothes dryer.

Clothes hanging bar 25 is attached to telescoping rods 17 by means of a cylindrical support 27 having caps 28 and 30 on each end thereof which may have a pair of bushings 31 and 32 connected to telescoping rod 17. Bushings 31 and 32 may be attached to the cylindrical support member 27 as illustrated in FIGS. 1 and 4 so that the clothes hanging bar 25 can pivot from its vertical position all the way over the top of the telescoping rod 17 to a horizontal position illustrated in FIG. 1 supported by a support bracket 34 fixedly attached to telescoping rod 17 and adapted to receive the head portion 33 attached to the clothes hanging bar 25. The clothes hanging bar 25 is pivoted from its vertical position to its horizontal position as illustrated in FIG. 3 by the dashed line. The capped portions 28 and 30 hold the bushings 31 and 32 in position on the cylindrical support 27. The clothes hanging bar 25 may be positioned in its vertical storage position to one side of the telescoping bar 17, by rotation of the bar 17 when removing locking pins 18 and 20 from slots 23 and 24 to slot 21 so that clothes hanging bar 25 aligns with bore 16 and may be telescoped into bore 16 of container 11 as illustrated in FIG. 4. Thus, both the telescoping rods 17 and clothes hanging bar 25 are positioned in the container in a compact manner out of the way of the general everyday operation of the laundry room when laundry is ready to be removed from the clothes dryer. The pins 18 and 20, which are fixedly attached to the telescoping rod 17, can also be used to raise the telescoping rod 17 and to rotate the locking pins 18 and 20 in the slots 23 and 24 in its upright operating position. The vertically extending clothes hanging bar 25 will then have extended all the way out of the bore 16 of the container 11 and may be freely pivoted over the top of the rod 17 until the head 33 of the bar 25 rests in the support bracket 34, at which time clothes can be hung upon the bar 25 as they come out of the clothes dryer.

The present hanging rack is conveniently located and compactly stored, but may be rapidly swung into its clothes hanging positon to accept coat hangers with clothes thereon. It should also be clear that other embodiments are contemplated as being within the scope of the present invention which is not to be construed as limited to the particular forms disclosed herein, which are to be regarded as illustrative rather than restrictive.

We claim:

1. A clothes hanging rack comprising in combination:

a container having a pair of adjacent bores therein;

a telescoping rod mounted for telescoping into and out of one of said bores in said container;

a clothes hanging bar pivotally mounted to said telescoping rod for pivotal movement thereon and having a horizontal support positon and a folded storage position with said clothes hanging bar being positioned the other of said bores in said container in said folded storage position;

support bracket means for supporting said clothes hanging bar in a generally horizontal position when said clothes hanging bar is in its working position; and locking means for locking said telescoping rod in a telescoped position, whereby a foldable clothes hanging rack may be conveniently stored in a laundry room.

2. The apparatus in accordance with claim 1, in which said locking means includes at least one locking pin attached to said telescoping rod and said container has at least one locking slot for receiving said locking pin for locking said telescoping rod in a raised position.

3. The apparatus in accordance with claim 2, in which said telescoping rod has two locking pins for simultaneously locking into two slots in said container.

4. The apparatus in accordance with claim 3, in which said container has an elongated vertical slot therein for said locking pins to slide in a pair of L-shaped slots connected to said elongated vertical slot for receiving said locking pins for locking said telescoping rod in a raised position.

5. The apparatus in accordance with claim 4, in which said clothes hanging bar and said telescoping rod are connected by a pair of bushings engaging a cylindrical bushing support member.

6. The apparatus in accordance with claim 5, in which said bushings are formed onto a rod end attaching member.

7. The apparatus in accordance with claim 6, in which said support bracket means includes an arcuate support bracket fixedly attached to said telescoping rod for receiving said offset clothes hanging bar.

8. The apparatus in accordance with claim 7, in which said container has attaching means for attaching said casing to a wall with said attaching means having screw receiving brackets fixedly attached thereto for attaching said container with screws to a wall surface.

9. The apparatus in accordance with claim 1, in which said locking means for locking said telescoping rod in a telescoped position includes means for locking said telescoping rod in two different positions.

* * * * *